US009255706B2

(12) United States Patent
Gross et al.

(10) Patent No.: US 9,255,706 B2
(45) **Date of Patent: *Feb. 9, 2016**

(54) SELF-DEFENSE FLASHLIGHT

(71) Applicant: PowerTech, Inc., Collierville, TN (US)

(72) Inventors: Barbara R. Gross, Collierville, TN (US); Danny J. Holmes, Collierville, TN (US)

(73) Assignee: PowerTech, Inc., Collierville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/271,713

(22) Filed: May 7, 2014

(65) Prior Publication Data

US 2014/0240970 A1 Aug. 28, 2014

Related U.S. Application Data

(63) Continuation of application No. 13/296,657, filed on Nov. 15, 2011, now Pat. No. 8,757,830.

(60) Provisional application No. 61/414,203, filed on Nov. 16, 2010.

(51) Int. Cl.

| | |
|---|---|
| ***A45B 3/02*** | (2006.01) |
| ***F21V 33/00*** | (2006.01) |
| ***B43K 29/10*** | (2006.01) |
| ***F41B 15/06*** | (2006.01) |
| ***F21L 4/00*** | (2006.01) |
| ***F41B 15/00*** | (2006.01) |

(52) U.S. Cl.

CPC ..... *F21V 33/0076* (2013.01); *A45B 3/02* (2013.01); *B43K 29/10* (2013.01); *F21L 4/00* (2013.01); *F41B 15/00* (2013.01); *F41B 15/06* (2013.01)

(58) Field of Classification Search

CPC ..... F41B 15/00; F41B 15/06; A45B 3/02; A45B 3/14; B43K 29/10; F21V 33/0064; F21W 2111/10

USPC ..... 362/102, 118, 119

See application file for complete search history.

(56) References Cited

U.S. PATENT DOCUMENTS

| | | | | |
|---|---|---|---|---|
| 5,363,285 | A * | 11/1994 | Wideman | 362/102 |
| 6,299,324 | B1 * | 10/2001 | Kim | 362/119 |
| 6,592,236 | B1 * | 7/2003 | Lin | 362/119 |
| 8,231,474 | B2 * | 7/2012 | Stethem | 463/47.3 |
| 8,757,830 | B2 * | 6/2014 | Gross et al. | 362/102 |
| 2005/0037847 | A1 * | 2/2005 | Pickens | 463/47.2 |

* cited by examiner

*Primary Examiner* — Peggy Neils

(74) *Attorney, Agent, or Firm* — Triangle Patents, PLLC

(57) ABSTRACT

A self-defense device that includes a flashlight with a weapon end, tissue-abrading and tissue-collecting features, and with or without a writing instrument.

20 Claims, 4 Drawing Sheets

SELF-DEFENSE FLASHLIGHT

BACKGROUND OF THE INVENTION

1. Field of the Invention

The present invention relates to self-defense devices, and specifically to self-defense flashlights.

2. Description of the Prior Art

Pen lights have been described for several decades with the earliest documents dating back to the early 1920's. Several inventions described pen-shaped lights with or without a writing instrument. However, none of these documents appear to describe the further function of the device as an instrument for self-defense. Devices combining a pen light with other applications such as USB drives, pen fans, projectors, barcode readers and scanners also exist. Inventions relating to pen-shaped laser pointers, pen-shaped styluses, and pen-shaped devices using infra-red for input to computers also exist. Other inventions describe portable lights or flash lights combined with stun guns, marksmen trainers and knives to be used as weapons.

U.S. Pat. No. 5,673,996 for "Pen with LED Indicator" describes a pen which includes a light assembly comprising of a lamp, battery and a switch in the upper portion of the barrel. The invention further includes a switch-on and off position to control the LED lamp.

U.S. Publication 2010/0104350 for "LED Luminous Pen" describes a LED luminous pen comprising of a pen-core, battery, circuit board and a LED with the battery in the upper portion of the penholder and the LED in the lower portion of the penholder. The invention further includes a rotary assembly comprising of a metallic connecting casing.

U.S. Publication 2006/0285317 for "Pen with Light Source" describes a pen with light source comprising a case with press-on turning device and a lower case containing a pen-refill. The invention further describes a lighting device inserted inside the upper and lower cases. The lighting device comprises of a battery socket, batteries, a lamp socket and a lamp.

U.S. Pat. No. 6,161,936 for "Portable Lighting Device" describes a pen-type portable lighting device with a battery casing and a miniature lamp holder near the end of the battery casing. The invention further describes a miniature lamp mounted on the lamp holder which surrounds the light emitting portion.

U.S. Pat. No. 6,948,827 for "LED Flashlight Construction" describes an LED flashlight construction comprising of a molded plastic housing. The invention further includes a hollow tubular section comprising of a semi-cylindrical tube with a connected battery chamber. The device may also be pen-shaped.

SUMMARY OF THE INVENTION

The present invention relates to self-defense devices.

It is an object of this invention to provide a self-defense light source.

Yet another object of this invention to provide to provide a self-defense light source with a tissue sampler.

A further object of this invention is to provide a self-defense light source with a tissue sampler and a writing instrument.

Accordingly, a broad embodiment of this invention is directed to a flashlight with a weapon end, tissue-abrading features, and a writing instrument.

These and other aspects of the present invention will become apparent to those skilled in the art after a reading of the following description of the preferred embodiment when considered with the drawings, as they support the claimed invention.

DETAILED DESCRIPTION

Figure 1:
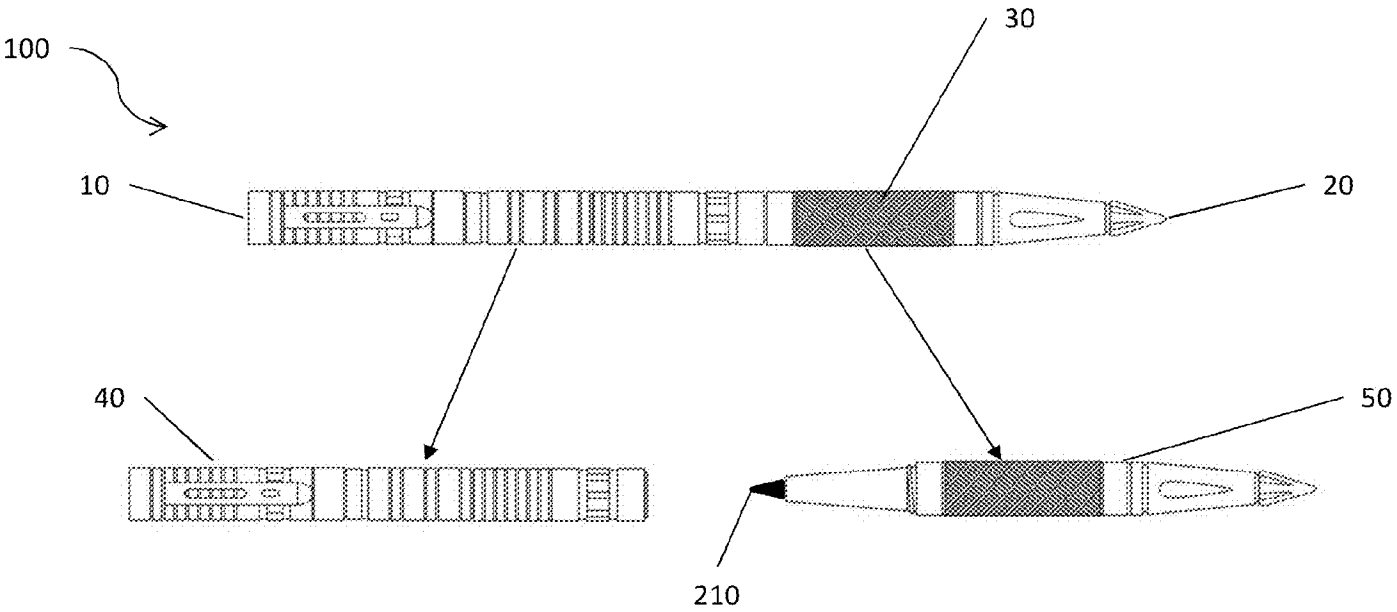
FIG. 1 is a drawing of one embodiment of the invention.

U.S. Provisional Application 61/414,203 and U.S. application Ser. No. 13/296,657 are hereby incorporated by reference in their entirety.

Referring now to the drawings in general, the illustrations are for the purpose of describing a preferred embodiment of the invention and are not intended to limit the invention thereto.

The present invention provides for a generally tubular-shaped, multifunctional self-defense device, generally described as 100 in FIG. 1. The multifunctional self-defense device includes a blunt end 10 and a sharp end 20. The device is designed to be used as a self-defense striking object. As such, the device is designed to be gripped and preferably contains one or more non-slip sections 30 to prevent slipping when striking. The device is also preferably made from hard, impact-resistant material that can be used to break glass and is also preferably lightweight for ease of carrying. For example, the tubular shape is preferably composed of aluminum, titanium or similar materials. More preferably, the tubular shape is composed of anodized aircraft aluminum or any similar strong material.

Figure 2:
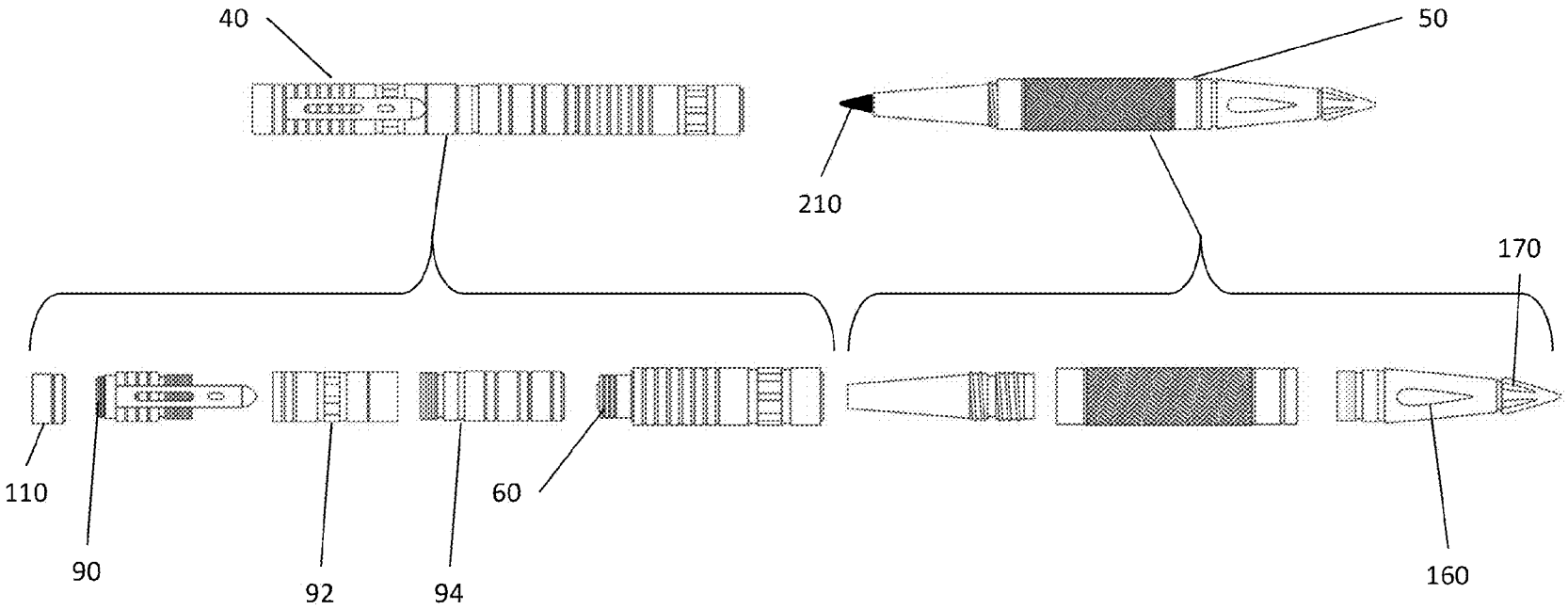
FIG. 2 is an exploded drawing of the embodiment of FIG. 1.

The device is composed of first section 40 and a second section 50 that are joined together. The two sections preferably are threaded to screw together. As shown in FIG. 2, the blunt section 40 is further separable to permit the exchange of a battery 60 contained inside the device and the two sections preferably screw together to turn a light on and off. Alternatively, a switch (not shown) can be used to activate the light. The two sections are generally described as a blunt section 40 and a sharp section 50.

The two sections preferably can operate independently of each other. For example, if the blunt section contains a light and the sharp section contains a pen, once the parts are separated the light can still be operated and the sharp section can still be used as a pen or a self-defense weapon. In these cases, the switch to operate the light is completely incorporated in the blunt section. Thus, the device is operable to provide lighting to the user when the user is using the writing device.

The blunt section 40 contains a light source 90 configured so that the device functions as a flashlight. Preferably, the light is a light-emitting diode (LED). As such, the light contained in the blunt section is recessed and/or the blunt end has a lens (not shown) and/or a shield 110 protecting the light. Preferably, blunt end is designed and configured so that the light emitted is not visible laterally. For example, a protective shield xx is solid, rather than perforated.

The blunt section further includes sections housing electronic circuit boards 92 and 94 for controlling an LED light.

All the sections are preferably threaded together. The sections that do not need to be opened or manipulated by a user are preferably locked together using a threadlocking adhesive, such as Loctite adhesives.

The end of the blunt section is smooth to prevent a user from hurting his/her thumb or other digit that is holding the end while striking an object with the device.

Figure 3:
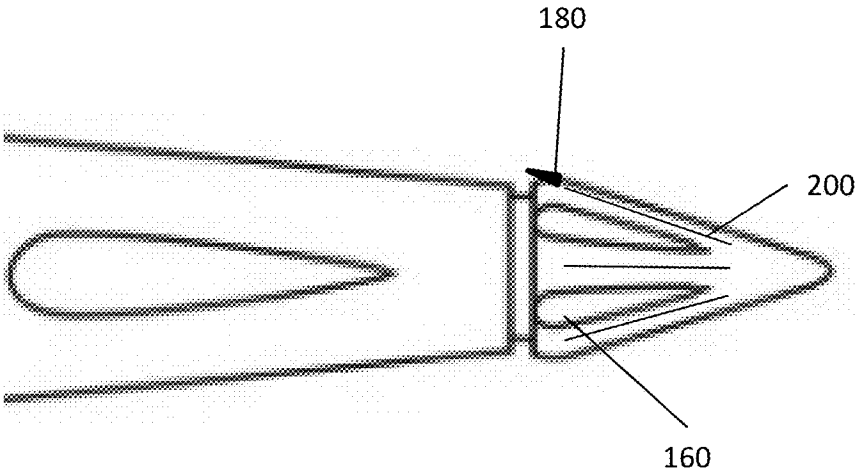
FIG. 3 is a close-up drawing of the tip of an embodiment of the invention.

The pointed section of the device is pointed such that it will puncture tissue and clothing when struck against these. The pointed section includes large grooves 160, shown in FIG. 3, herein called "blood channels", to facilitate bleeding upon stabbing.

The pointed section preferably includes a bulbous feature 170 to facilitate bleeding upon stabbing. The bulbous feature 170 is generally shaped like a spear tip or arrowhead.

The pointed section preferably includes tissue-capturing elements for obtaining tissues samples for biological identification. The pointed section preferably includes barbs 180 to capture tissue from an assailant when the sharp end of the device penetrates the assailant's tissue. Deep, narrow grooves 200 are preferably included in the pointed section. The grooves are sufficiently deep and narrow such that they are difficult to clean by merely rinsing and wiping. Thus, the deep narrow grooves make it difficult for an assailant to quickly clean away any tissue samples collected on the device.

The tubular shape preferably includes a writing device 210, such as an ink pen cartridge, that extends from the internal end of the pointed section. The ink pen cartridge is enclosed to prevent damage when the pointed section is being used for self-defense or otherwise to strike an object. Refill pen cartridges are also contained within the pointed section of the pen. In another embodiment (not shown), the pen is reversed, extending out the pointed end, and retractable.

Figure 4:
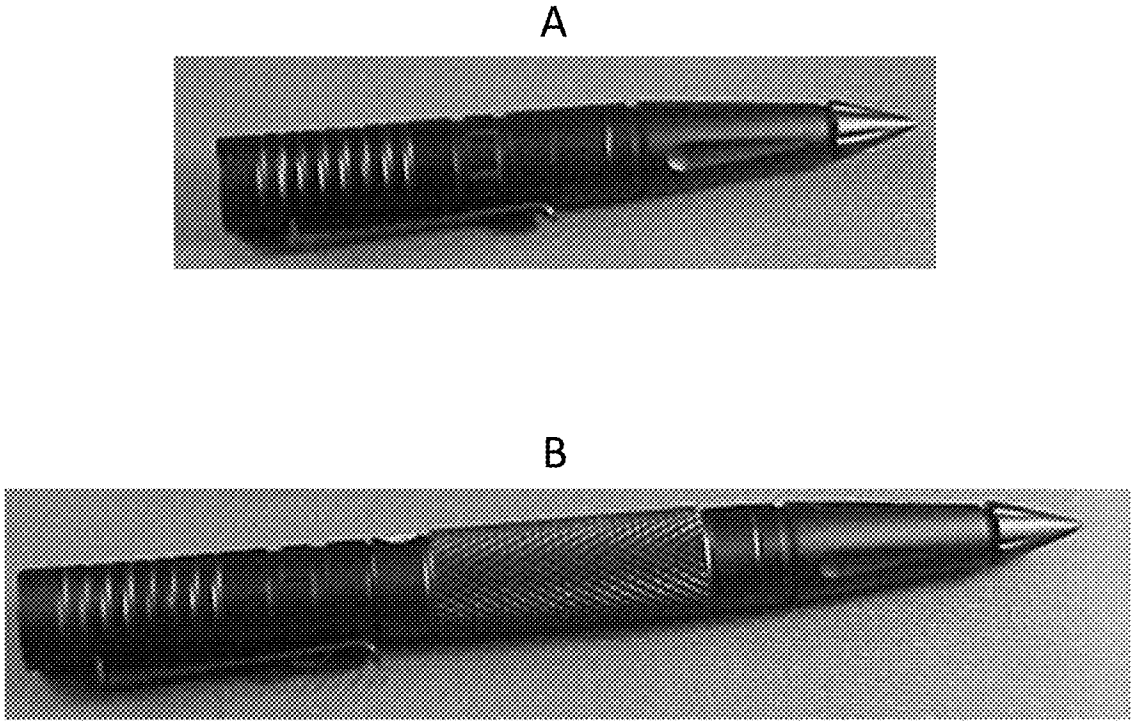
FIG. 4 show example embodiments A and B of the invention.

The pointed section also preferably includes threads (not shown), such that accessory devices can be mounted on the flashlight. For example, a firestarter, knife sharpener, hammer head, wrench, and any tool that needs a handle can be mounted on the device. Different sizes of the present invention are possible, as shown in FIG. 4. Smaller versions of the present invention, shown as embodiment A, use a single battery 220 and are sized such that they can be attached to a key chain and not cause an inconvenience. A larger version, shown in embodiment B, uses a larger battery or multiple batteries and is sized more as a writing instrument.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A multifunctional self-defense device including:

a blunt section and a sharp section that are removably joined together and coaxially aligned to form a tubular shaped housing;

the blunt section including a light source and a power source;

the sharp section including a pointed section including a bulbous feature positioned farthest from the blunt section;

wherein the bulbous feature includes a point on the end of the device, a first set of spaced-apart grooves on its surface, and barbs;

wherein the barbs are positioned between the grooves.

2. The device of claim 1, wherein the barbs are angled inwardly towards the point forming a lip around the circumference of the sharp section.

3. The device of claim 1, wherein the blunt section further includes threads for mounting accessories.

4. The device of claim 1, wherein the sharp section further includes a writing device.

5. The device of claim 4, wherein the writing device is enclosed within the housing.

6. The device of claim 4, wherein the writing device is extendable and retractable.

7. The device of claim 4, wherein the two sections can operate independently of each other.

8. The device of claim 1, wherein the light source is an LED.

9. The device of claim 1, wherein the blunt end is configured with a solid protective shield so the light is not visible laterally.

10. The device of claim 9, wherein the solid protective shield is smooth to prevent injury to a user.

11. The device of claim 3, further including a handle-mounted accessory mounted on the blunt section.

12. The device of claim 11, wherein the handle-mounted accessory is selected from the group consisting of fire starter, knife sharpener, hammer head, and wrench.

13. The device of claim 1, further including a non-slip grip.

14. The device of claim 1, wherein the device is made from a lightweight, hard, impact-resistant material that can be used to break glass.

15. The device of claim 14, wherein the material is selected from the group consisting of aluminum, titanium and combinations thereof.

16. The device of claim 1, wherein the sections are threaded to screw together.

17. The device of claim 16, wherein the two sections preferably screw together to switch the light on and off.

18. The device of claim 1, further including a second set of spaced-apart grooves in the sharp section, wherein the first set of grooves are narrower than the second set of grooves and positioned closer to the point.

19. The device of claim 1, wherein the grooves are equally spaced apart around the circumference of the sharp section.

20. A multifunctional self-defense device including:

a blunt section and a sharp section that are removably joined together and coaxially aligned to form a tubular shaped housing;

the blunt section including a light source and a power source;

the sharp section including a writing device within the housing and a pointed section including a bulbous feature positioned farthest from the blunt section;

the bulbous feature including a point on the end of the device, a first set of spaced-apart grooves on its surface, and barbs;

wherein the blunt section and the sharp section are operable if the sections are separated.

* * * * *